US005546114A

United States Patent [19]

Tait et al.

[11] Patent Number: 5,546,114

[45] Date of Patent: Aug. 13, 1996

[54] SYSTEMS AND METHODS FOR MAKING PRINTED PRODUCTS

[75] Inventors: David B. Tait, West Linn, Oreg.; B. Jay Burreson, Vancouver, Wash.; Thomas J. Brandt, Canby, Oreg.

[73] Assignee: Tektronix, Inc., Wilsonville, Oreg.

[21] Appl. No.: 930,572

[22] Filed: Aug. 17, 1992

Related U.S. Application Data

[63] Continuation-in-part of Ser. No. 762,537, Sep. 18, 1991.

[51] Int. Cl.[6] ..... B41J 2/325

[52] U.S. Cl. ..... 347/212

[58] Field of Search ..... 366/76 PH; 400/120, 400/120.18; 347/212

[56] References Cited

U.S. PATENT DOCUMENTS

| | | | |
|---|---|---|---|
| 3,989,131 | 11/1976 | Knirsch et al. | 197/1 R |
| 4,080,897 | 3/1978 | Gundlach | 101/467 |
| 4,374,691 | 2/1983 | Vanden Bergh | 156/234 |
| 4,399,749 | 8/1983 | Arai | 100/211 |
| 4,415,903 | 11/1983 | Kawanishi et al. | 346/1.1 |
| 4,442,342 | 4/1984 | Yoneda | 219/216 |
| 4,491,432 | 1/1985 | Aviram et al. | 400/241.1 |
| 4,503,095 | 3/1985 | Seto et al. | 427/265 |

(List continued on next page.)

FOREIGN PATENT DOCUMENTS

| | | |
|---|---|---|
| 193342A | 2/1986 | European Pat. Off. . |
| 55-71585 | 5/1980 | Japan . |
| 58-219087 | 12/1983 | Japan . |
| 59-61273 | 5/1984 | Japan . |
| 60-9772 | 1/1985 | Japan . |
| 60-189461 | 9/1985 | Japan . |
| 60-199676 | 10/1985 | Japan . |
| 61-286194 | 12/1986 | Japan . |
| 61-286193 | 12/1986 | Japan . |
| 62-5863 | 1/1987 | Japan . |
| 62-38160 | 2/1987 | Japan . |
| 62-80078 | 4/1987 | Japan . |
| 62-77987 | 4/1987 | Japan . |
| 62-108089 | 5/1987 | Japan . |
| 62-257863 | 10/1987 | Japan . |
| 62-282954 | 12/1987 | Japan . |
| 63-4970 | 1/1988 | Japan . |
| 63-134259 | 6/1988 | Japan . |
| 63-253201 | 10/1988 | Japan . |

OTHER PUBLICATIONS

Maehashi, et al., *Journal of Imaging Science,* vol. 35, No. 6, Nov. /Dec. 1991, pp. 387–393.

Aviram, et al., *Journal of Imaging Technolgy,* vol. 17, pp. 295–298 (1991).

"Relation Between Dymanic Characteristics of Thermo–Fusible Ink and Print Quality in Thermal Transfer Printing," *Journal of Imaging Technology,* vol. 17, pp. 119–122, Jun./Jul. 1991.

Tokunega et al., *IEEE Trans. of Electron. Devices,* vol. ED–27, pp. 218–222, 1980.

*Primary Examiner*—Huan H. Tran

*Attorney, Agent, or Firm*—Ralph D'Alessandro; John L. Knoble

[57] ABSTRACT

A method of thermal transfer printing on a substrate includes the steps of determining, on a pixel by pixel basis, where colorant is to be located on the substrate; applying an image-enhancing precoat to each pixel where colorant is to be located, as well as to at least one immediately adjacent pixel; and depositing a colorant onto the precoated predetermined pixels. The precoating that is applied to the immediately adjacent pixels helps retain the precoating to the substrate, among other advantages. A second method, for printing on a rough substrate, includes steps of applying an image enhancing precoat so as to form bridges across valleys of said rough surface; and subsequently depositing a colorant onto the precoat. A third printing method includes the steps of applying a precoat to the substrate which has one or more voids defined therein; and depositing a colorant onto the precoat so as to bridge over the voids in the precoat. Related systems and printed products are also disclosed.

83 Claims, 6 Drawing Sheets

U.S. PATENT DOCUMENTS

| | | | |
|---|---|---|---|
| 4,525,722 | 6/1985 | Sachdev et al. | 346/1.1 |
| 4,527,171 | 7/1985 | Takanashi et al. | 346/76 PH |
| 4,532,523 | 7/1985 | Tanaka | 346/76 PH |
| 4,536,771 | 8/1985 | Tanaka | 346/76 PH |
| 4,549,824 | 10/1985 | Sachdev et al. | 400/241.1 |
| 4,555,714 | 11/1985 | Takanashi et al. | 346/76 PH |
| 4,590,490 | 5/1986 | Takahashi et al. | 346/76 PH |
| 4,623,580 | 11/1986 | Koshizuka et al. | 428/216 |
| 4,633,269 | 12/1986 | Mikami et al. | 346/76 PH |
| 4,652,892 | 3/1987 | Tanaka | 346/76 PH |
| 4,670,307 | 6/1987 | Onishi et al. | 427/261 |
| 4,691,211 | 9/1987 | Brownstein | 346/76 PH |
| 4,704,615 | 11/1987 | Tanaka | 346/76 PH |
| 4,764,776 | 8/1988 | Mugrauer et al. | 346/76 R |
| 4,804,976 | 2/1989 | Ohmori et al. | 346/76 PH |
| 4,827,286 | 5/1989 | Sukigara et al. | 346/76 PH |
| 4,827,288 | 5/1988 | Mori et al. | 346/76 PH |
| 4,870,428 | 9/1989 | Kuwabara et al. | 346/76 PH |
| 4,884,080 | 11/1989 | Hirahara et al. | 346/46 |
| 4,922,271 | 5/1990 | Nilsson et al. | 346/140 |
| 4,952,085 | 8/1990 | Rein | 400/120 |
| 4,955,736 | 9/1990 | Iwata et al. | 400/120 |
| 5,010,352 | 5/1991 | Takei et al. | 346/76 PH |
| 5,051,755 | 9/1991 | Takahashi et al. | 346/76 PH |
| 5,099,259 | 3/1992 | Hirahara et al. | 346/76 PH |
| 5,116,148 | 5/1992 | Ohara et al. | 400/241 |

SYSTEMS AND METHODS FOR MAKING PRINTED PRODUCTS

This Application is a Continuation-in-part of Ser. No. 07/762,537, filed Sep. 18, 1991, the disclosure of which is incorporated into this document as if set forth fully herein.

BACKGROUND OF THE INVENTION

1. Field of the Invention

This invention relates to improved methods of monochromatic and color printing on various types of substrate surfaces. More specifically, this invention relates to methods of thermal transfer printing (e.g., thermal wax transfer, dye diffusion transfer or the like) images or information on a substrate such as paper.

2. Description of the Prior Art

Thermal transfer printing, as defined herein, includes the known printing methods of thermal wax transfer printing, thermal dye diffusion printing, and the like.

Thermal wax transfer printing involves the transfer of a colorant (e.g., magenta, cyan, yellow and, possibly, black), which is dispersed in a wax base material, from a carrier onto a substrate surface such as smooth paper in a controlled manner to generate an image. A thermal transfer print engine having a large number of independently activatable heating elements per unit of length is one apparatus that has been employed for this purpose. The carrier is most often placed within the print engine such that one side of the carrier is adjacent to the heating elements and a second, opposite side bearing the wax base material is positioned adjacent to the substrate surface upon which printing is intended.

To accomplish image generation, the print engine and substrate are moved relative to each other. If a color is intended to be deposited at a location on the substrate surface with which the printhead is aligned, the appropriate heating element is activated, and the carrier is locally heated to a temperature at or above the melting point of the colorant. When this happens, an amount of the wax-based ink in the colorant softens and adheres to the substrate at the desired location, breaking away from the carrier and the unheated or insufficiently heated colorant. In generating a subtractive color image, three (cyan, magenta and yellow) or four (cyan, magenta, yellow and black) sequential passes are made over the same substrate with different carriers, each of which is dedicated to one of the primary colors.

Dye diffusion printing involves the transfer of a dye colorant from a carrier, such as a polymer ribbon, onto a specialized substrate surface, such as a polyester sheet, in a controlled manner to generate an image. A thermal transfer print engine and three different color dye/carrier structures may also be employed in this type of image generation, utilizing similar heat-induced, subtractive color printing techniques. The operating principles for dye diffusion are different from those of thermal wax transfer printing, however. In dye diffusion applications, the amount of dye deposited at a single location can be varied, so that more subtle color gradations are achievable. Images of near photo quality have been produced using dye diffusion technology.

If a color is to be deposited at a location on the substrate surface with which the printhead of the thermal transfer print engine is aligned, the appropriate heating element is activated, and the dye/carrier structure is heated to a temperature sufficient to cause migration of an appropriate amount of dye, thereby releasing the dye from the carrier in the vicinity of the specially structured substrate. In this manner, the appropriate amount of dye contacts and penetrates the substrate through molecular dispersion of the dye in the substrate at the desired location.

Many types of paper, particularly the bond-type paper which is popular in the United States, exhibits a rough surface, featuring plateaus and voids. Conventional prior art thermal transfer printing techniques cannot be effectively used with such paper, because the voids in the paper substrate surface structure cause adherence problems or broken ink or dye dots.

Also, most paper is not chemically compatible with diffusion dyes in a manner to provide a solid-in-solid dye-substrate solution. As a result, bright colored images cannot be generated on such substrates using dye diffusion technology. Since "plain paper" exhibiting a rough surface is less costly than specialized substrate materials, and high quality images are obtainable using thermal transfer techniques, methods of color printing on plain paper substrates are desirable.

One method of expanding the range of substrates useful in thermal transfer printing involves the choice of inks or dyes used to generate the image. For example, Abe and Kitamura suggest the use of inks having increased tensile strength to decrease the number and severity of image voids for monochrome printing applications in an article entitled "Relation Between Dynamic Characteristics of Thermo-Fusible Ink and Print Quality in Thermal Transfer Printing," Journal of Imaging Technology, Vol. 17, No. 3, pp. 119–122, June/July 1991.

Another method of increasing the number of usable substrates proposed for use in monochrome printing applications is the employment of a carrier with multiple layers of ink disposed thereon. Theoretically, the first ink layer deposited on the substrate surface improves the deposition of the simultaneously deposited second layer. U.S. Pat. No. 4,623,580 issued to Koshizuka et al. is directed to this technology.

Such monochrome technology is not amenable to the multi-pass methodology employed in subtractive color printing, however. In multi-pass color printing, the deposition of multiple layers of colorant can result in loss of image resolution and adhesion as a consequence of the cumulative thickness of the deposited layers.

More recently, it has been suggested to deposit a precoat onto the substrate surface which is smoother and more chemically compatible with the intended colorant than the substrate surface is. U.S. Pat. Nos. 4,527,171 issued to Takanashi et al., 4,670,307 issued to Onishi et al. and 4,704,615 issued to Tanaka are examples of thermal transfer printing systems which utilize a fusible binder material that is deposited as a precoating onto the substrate prior to printing.

Takanashi et al. coat the entire substrate upon which printing is intended with a layer of the binder material. This method effectively prepares the substrate for deposition of colorant during printing, but consumes a large amount of the binder which is used during the precoating process. In addition, it results in a discernable smoothening of the surface of the substrate, which may be objectionable to those who prefer the look and feel of plain paper.

In Tanaka, the precoating is applied to the substrate on a pixel by pixel basis, to the same pixel locations as where the deposition of colorant is intended. The precoating is applied to a slightly broader area at each pixel location than the colorant, as a result of a longer pulse width being applied to the printhead element during deposition of the precoat material. While the Tanaka system preserves the look and feel of plain paper for that portion of the substrate which had not been printed on, certain problems still exist. Specifically, it has been found that, in some instances, it is difficult to effectively apply the precoating to the substrate in discrete one pixel intervals. Such problems are most common in areas where the desired image requires that the colorant be applied only very sparsely to the substrate. In such areas, it appears that the combined effect of heat loss from a single activated heating element on the printhead and the transitional period needed to bring the heating element to its operational temperature result, at times, in a less than satisfactory deposition of the precoat material to the substrate.

The precoat material in Tanaka was designed so as to fill the voids or valleys-which are defined in the surface of a rough substrate, rather than bridging over such voids or valleys. This is typical of the precoat technology which is in common use today. Japanese patent publication 62-77987, assigned to Mitsubishi Chemical Industries, Ltd., discloses the deposition of a combined stratum of an adhesive layer and an ink layer to a rough substrate in such a manner that the adhesive layer bridges the voids or valleys in the substrate, but the deposition of a bridging-type precoat or surface preparation layer which is applied separately from the colorant has not heretofore been known to those skilled in this area of technology.

It is clear that there has existed a long and unfilled need in the prior art for an improved system and method for making printed products which overcomes the disadvantages discussed above.

SUMMARY OF THE INVENTION

Accordingly, it is an object of the invention to provide an improved system and method for making printed products, which provides improved image adhesion to a rough substrate, such as bond type paper.

It is further an object of the invention to provide an effective system and method for thermal transfer printing on a rough substrate, which preserves the rough look and feel of the substrate in areas where an image has not been printed.

It is yet further an object of the invention to provide an improved system and method for printing on a rough substrate, of the type which utilizes an image enhancing precoat, which will not suffer reduced image quality as a result of voids in the colorant application surface of the precoat.

It is yet further an object of the invention to provide an improved printed product that is consistent with the objects expressed hereinabove.

In order to achieve the above and other numerous objects of the invention, a method of thermal transfer printing on a substrate of the type which is characterized by a rough surface having peaks and valleys, includes the steps of (a) applying an image-enhancing precoat to the rough surface so as to form bridges across the valleys of the rough surface between adjacent peaks while leaving substantial voids in the valleys between the peaks so as to create a colorant receiving surface more uniform than the rough surface; and (b) subsequently depositing a colorant on the colorant receiving surface of the previously deposited image enhancing precoat.

A method of thermal transfer printing on a substrate of the type which is characterized by a rough surface having peaks and valleys, according to a second aspect of the invention may include the steps of (a) applying an image enhancing precoat to the rough surface which partially fills the valleys of the rough surface while leaving some voids in the valleys, creating a partial bridging effect between the peaks, thereby forming a colorant receiving surface which is more uniform than the rough surface; and (b) subsequently depositing a colorant on the colorant receiving surface of the previously deposited image enhancing precoat.

A system for thermal transfer printing on a substrate of the type which is characterized by a rough surface having peaks and valleys, may include, according to a third aspect of the invention, structure for applying an image-enhancing precoat on to the rough surface so as to form bridges across the valleys of the rough surface between adjacent peaks while leaving substantial voids in the valleys between the peaks so as to create a colorant receiving surface more uniform than the rough surface; and structure for subsequently depositing a colorant having a first color on the colorant receiving surface of the previously deposited image enhancing precoat.

According to a fourth aspect of the invention, a method of thermal transfer printing on a substrate includes the steps of (a) determining, on a pixel by pixel basis, where colorant is to be located on the substrate; (b) applying an image-enhancing precoat to each predetermined pixel on the substrate where colorant is to be located, and also to at least one pixel which is immediately adjacent to each predetermined pixel, but not to any pixels which are not one of said predetermined pixels or are not immediately adjacent to one of said predetermined pixels, whereby adherence of the precoat to the substrate is further assured; and (c) depositing a colorant onto the precoated predetermined pixels.

A system for thermal transfer printing on a substrate according to a fifth aspect of the invention includes structure for determining, on a pixel by pixel basis, where colorant is to be located on the substrate; structure for applying an image-enhancing precoat to each predetermined pixel on the substrate where colorant is to be located, and also to at least one pixel which is immediately adjacent to each predetermined pixel, but not to any pixels which are not one of said predetermined pixels or are not immediately adjacent to one of said predetermined pixels, whereby adherence of the precoat to the substrate is further assured; and structure for depositing colorant on to the precoated predetermined pixels.

According to a sixth aspect of the invention, a printed product for conveying information to a viewer, includes a substrate; an image-enhancing precoat applied to the substrate in discrete pixels; and at least one colorant pixel applied to a corresponding number of precoat pixels, wherein the precoat pixels are arranged on said substrate such that at least one precoat pixel is positioned immediately adjacent to each precoat pixel that has a colorant pixel applied thereto, but so that no precoat is applied to any pixel which is not immediately adjacent to a precoat pixel to which colorant has been applied.

A method of thermal transfer printing on a substrate, includes, according to a seventh aspect of the invention the steps of (a) applying an image enhancing precoat to a surface of the substrate, the precoat having an upper colorant receiving surface which has one or more voids defined therein; and (b) depositing a colorant on the colorant receiving surface, the colorant being formulated and deposited in such a manner so as to cause the deposited colorant to bridge over the voids in the colorant receiving surface.

According to a eighth aspect of the invention, a system for thermal transfer printing on a substrate, may include structure for applying an image enhancing precoat to a surface of a substrate, the precoat having a colorant receiving surface which has one or more voids defined therein; and structure for depositing a colorant on the colorant receiving surface, the colorant being formulated and deposited in such a manner so as to cause the deposited colorant to bridge over the voids in the colorant receiving surface.

A printed product according to a ninth aspect of the invention may include a substrate; an image-enhancing precoat adhered to the substrate, the precoat having a colorant receiving surface which has at least one void defined therein; and a colorant adhered to the colorant receiving surface, the colorant being formulated and deposited so as to bridge over the voids in the colorant receiving surface.

A method of thermal transfer printing on a substrate, includes, according to an tenth aspect of the invention, steps of (a) determining, on a pixel-by-pixel basis, where colorant and underlying image-enhancing precoat are to be located on the substrate; (b) determining, on a pixel by pixel basis, where additional exposed precoat is to be located contiguous with the underlying image-enhancing precoat; (c) applying the image-enhancing precoat to each predetermined pixel on the substrate where colorant is to be located and also to at least one additional pixel which is contiguous to each area where pixels of colorant are to be located, whereby adherence of the precoat to the substrate is further assured; and (d) depositing colorant onto the underlying precoat but not the additional exposed precoat.

A printed product for conveying information to a viewer, according to an eleventh aspect of the invention, includes a substrate, an image-enhancing precoat adhered to the substrate, the precoat having a colorant receiving surface which has at least one void defined therein; and a colorant adhered to the colorant receiving surface, the colorant being formulated so as to have a lower viscosity than the precoat.

According to a twelfth aspect of the invention, a printed product for conveying information to a viewer includes a substrate, an image-enhancing precoat adhered to the substrate, the precoat having a colorant receiving surface which has at least one void defined therein; and a colorant adhered to the colorant receiving surface, the colorant being formulated so as to have a lower melting temperature than the precoat.

According to a fourteenth aspect of the invention, a method of producing high quality color images, having a decrease in number or severity of image voids, on a substrate characterized by a rough surface using a dye diffusion printed technique to selectively deposit a desired amount of one or more dyes onto the substrate surface, the method including the step of depositing an image enhancing precoat onto the substrate surface using a dye diffusion print engine prior to dye deposition, wherein the image enhancing precoat exhibits compatibility with the substrate surface sufficient to provide, in combination with the substrate surface, a more uniform printing surface and exhibits compatibility with the dye sufficient to permit dye diffusion.

According to a fourteenth aspect of the invention, a transfer mechanism for producing high quality color images, having a decrease in number of severity of image voids, on a substrate characterized by a rough surface using a dye diffusion printing technique to selectively deposit an image enhancing precoat on the substrate surface prior to dye deposition includes an image enhancing portion including an image enhancing precoat exhibiting compatibility with the substrate surface sufficient to provide, in combination with a substrate surface, a more uniform printing surface, and a support therefor; and at least one colored portion including a dye or a mixture of dyes exhibiting compatibility with the image enhancing precoat sufficient to permit dye diffusion and a support therefore.

According to a fifteenth aspect of the invention, a printing apparatus for producing high quality color images, having a decrease in number or severity of image voids, on a substrate characterized by a rough surface using a dye diffusion printing technique to selectively deposit an image enhancing precoat on the substrate surface prior to dye deposition includes a printhead which exhibits dye diffusion printing capability; a controller for directing the action of the printhead to achieve deposition of the image enhancing precoat and at least one dye upon the substrate surface; and an input structure to communicate desired deposition locations of image enhancing precoat and dye to the controller, wherein the apparatus is used in combination with a transfer mechanism including an image enhancing portion comprising an image enhancing precoat exhibiting compatibility with the substrate surface sufficient to provide, in combination with a substrate surface a more uniform printing surface, and a support therefore; and at least one colored portion comprising a dye or mixture of dyes exhibiting compatibility with the image enhancing precoat sufficient to permit dye diffusion and a support therefore.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
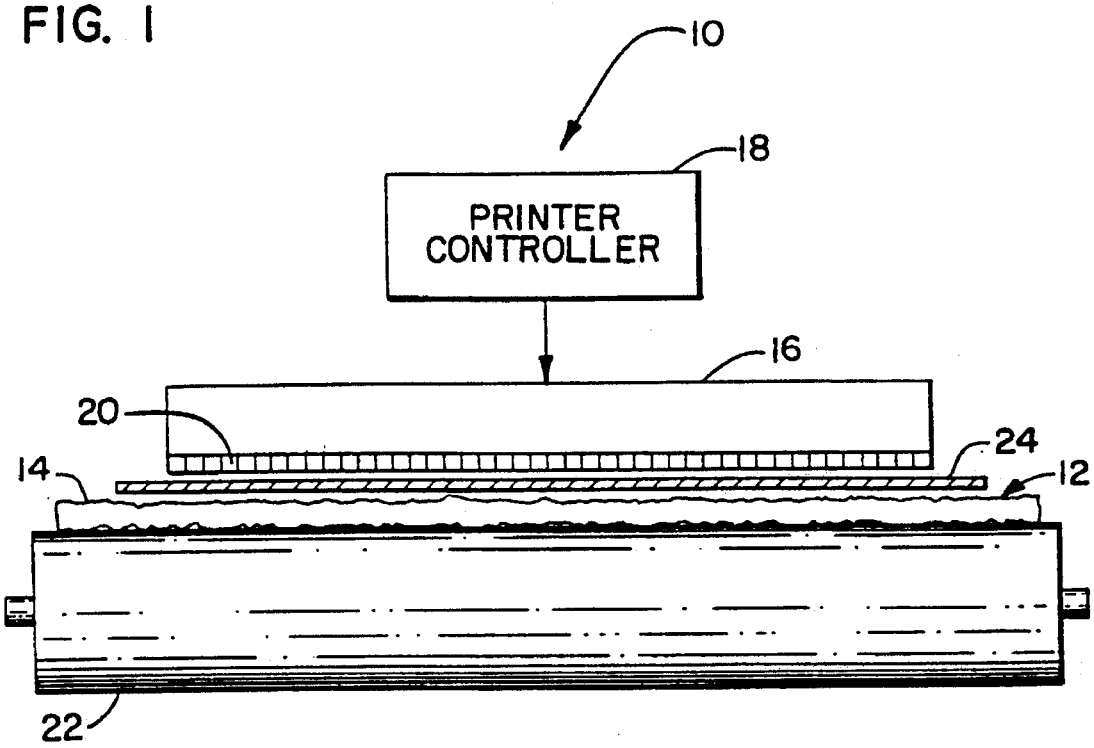
FIG. 1 is a schematic depiction of a printing system which is constructed according to a preferred embodiment of the invention.

Referring now to the drawings, wherein like reference numerals designate corresponding structure throughout the views, and referring in particular to FIG. 1, a system 10 for thermal transfer printing on a substrate 12 which may have a rough surface 14 includes a printhead element 16, which is responsive to commands from a printer controller 18. Printhead 16, according to the preferred embodiment of the invention, includes a linear array of heating elements 20, each of which may be heated in response to a command from the printer controller 18 by electrical resistance. A support roller 22 or equivalent surface is provided to support substrate 12 in parallel spaced relationship with respect to heating elements 20. By selectively controlling the heating elements 20 on printhead 16, printer controller 18 is constructed to control the placement of an image onto the substrate 12, as will be described in greater detail below.

Image creation is generally conducted in printer controller 18 using commercially available software specifically designed therefor, such as Adobe PostScript® and the like.

The printer assembly in system 10 may be one of several printers that are presently commercially available, including ColorPoint PS, CH-5504-RP10 (Seiko Instruments USA), Colormate PS Model 40 (NEC Technologies), ColorScript 100 Model 10 (QMS), Phaser II PXi (Tektronix), VY-5000 and VY 150 (Hitachi), S340 (Mitsubishi), XL7700 and SV6500 (Kodak), 4CAST (Dupont), A4JX-560 (Sharp Electronics), UP-5000 (Sony), CIP1024P (Copal), CP-2 (Nikon) and the like. Most preferably, system 10 utilizes the A4JX-560 printer manufactured by Sharp Electronics.

To overcome the problems of printing on a rough surface 14 of a substrate 12 such as bond type paper, one aspect of the invention involves the application of an image enhancing precoat to the rough surface 14, so as to provide a surface texture and chemistry which is more compatible with the intended colorant than he surface 14 of substrate 12 is.

Figure 2:
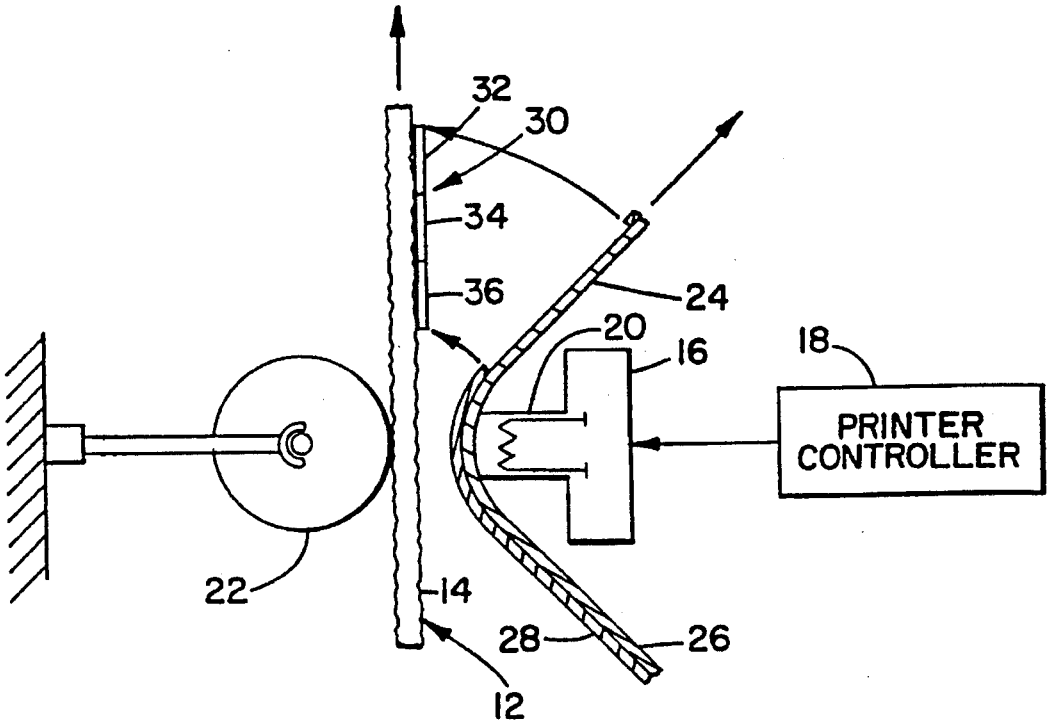
FIG. 2 is a diagrammatical view depicting application of a precoat material onto a substrate in a system constructed according to the embodiment of FIG. 1.

The deposition of such an image enhancing precoat 30 is depicted diagrammatically in FIG. 2. As may be seen in FIG. 2, a precoat application ribbon 24 is positioned between the heating elements 20 on printhead 16 and the surface 14 of substrate 12. Precoat application ribbon 24 includes a heat resistant backing 26, and a precoat forming layer 28 which is adhered to the backing 26 on a side of the backing 26 which is positioned adjacent to the surface 14 of substrate 12. Upon heating of a heating element 20 by the printer controller 18 to a predetermined temperature, an area of the precoat forming layer 28 which is approximately equal to the surface area of the distal end surface of the heating element 20 will soften or melt and begin to adhere to the rough surface 14 of substrate 12 with greater force than it adheres to the backing 26 of the precoat application ribbon 24. At this point, that area of the precoat forming layer 28 will separate from application ribbon 24 and become affixed to the surface 14 of substrate 12. This area portion is termed a pixel of precoat material 30. FIG. 2 depicts the application of three adjacent pixels 32,34,36 of precoat material 30. Printer controller 18 selectively applies such precoat pixels 32,34,36 to predetermined locations on the substrate 12 in response to the desired image which is intended to be printed on the substrate 12. This process is discussed in greater detail below. Optionally, more than one pass may be made over each pixel to ensure that the precoat is completely applied.

Materials exhibiting heat resistance as well as heat conductivity are preferably employed as the backing layer 26. Exemplary materials include polymer films and papers such as cellophane, polyamide film, polyester film, polyethylene film, polystyrene film, polypropylene film, condenser paper, glassins paper, synthetic paper, laminated paper and the like. Preferable carriers exhibit a thickness of from about 3 microns to about 25 microns and a density of from about 0.8 $g/cm^3$ to about 1.5 $g/cm^3$.

Most preferably, the backing layer 26 of precoat application ribbon 24 is formed of a layer of polyethylene terephthalate which is approximately 4 to 5 microns in thickness.

The precoat forming layer 28 and, thus, precoat pixels 32,34,36, are preferably of a wax-based composition. Exemplary wax base components are vegetable waxes such as carnauba wax, Japan wax, ouricury wax, esparts wax and the like; animal waxes such as bees wax, insect wax, shellac wax, spermaceti wax and the like; petroleum waxes such as paraffin wax, microcrystalline wax, ester wax, oxidized wax and the like; mineral waxes such as montan wax, azocerite, ceresine and the like; higher fatty acids such as palmitic acid, stearic acid, margaric acid, behenic acid and the like; higher alcohols such as palmityl alcohol, stearyl alcohol, behenyl alcohol, margaryl alcohol, myricyl alcohol, eicosanol and the like; higher fatty acid esters such as cetyl palmirate, myricyl palmitate, cetyl stearate, myricyl stearate and the like; amides such as acetamide, propionic acid amide, palmitic acid amide, stearic acid amide, oleic acid amide, amide wax and the like; polyamides; primary and secondary fatty acid amides; rosin derivatives such as ester gum, rosin maleic acid resin, rosin phenol resin, hydrogenated rosin and the like; rosin esters; macromolecular compounds having a softening point of from about 40° C. to about 120° C., such as phenol resin, terpene resin, cyclopentadiene resin, aromatic resin and the like; higher amines such as stearylamine, behenylamine, palmitinamine and the like; polyethylene oxides such as polyethylene glycol 4000, polyethylene glycol 6000 and the like; and the like. These materials may be used independently or in combination to form a base for a thermal wax transfer ink useful in the practice of the present invention.

The precoat forming layer 28 is most preferably from between 7 to 15 microns in thickness, and is formed of a mixture of carnauba wax, paraffin wax, microcrystalline wax, and ethylene vinyl acetate (EVA). The relative percentages of those components in the precoat forming layer 28 will be discussed in greater detail below with reference to the embodiments of FIGS. 3 and 4.

Figure 3:
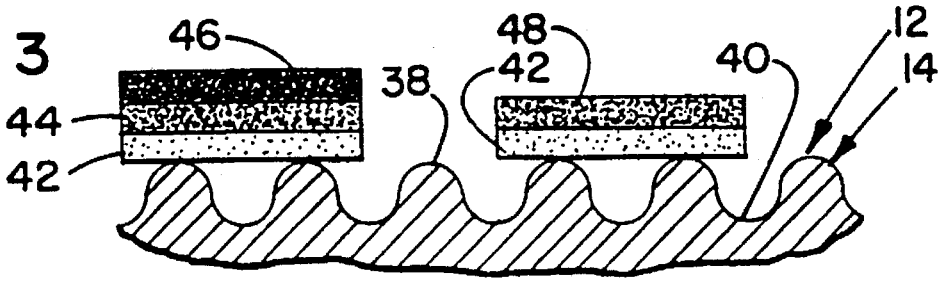
FIG. 3 is a diagrammatical view depicting adhesion of a first type of precoat according to the invention to an underlying substrate.

Referring now to FIG. 3, it will be seen that the rough surface 14 of substrate 12 can be considered to have a series of alternating peaks 38 and valleys 40. According to the embodiment of FIG. 3, the precoat material 30 is formulated so that each precoat pixel 42 will form complete bridges across the valleys 40 of the rough surface 14 between adjacent peaks 38 while leaving substantial voids in the valleys 40 between the peaks, thereby creating a colorant receiving surface which is more uniform than the rough surface 14.

To achieve the complete bridging effect depicted in FIG. 3, precoat material 30 is preferably formulated from between approximately 0–35% carnauba wax, 20–40% paraffin wax, 20–40% microcrystalline wax and 15–25% EVA.

Most preferably, complete bridging-type precoat material 30 is a formulation including about 30% carnauba wax, 20% paraffin wax, 30% microcrystalline wax and 20% EVA.

As may be seen in FIG. 3, a first colorant layer 44 may be directly applied an upper colorant receiving surface of a first precoat pixel 42. To achieve the desired color on the area of substrate 12 which is covered by the first precoat pixel 42, a second colorant layer 46 may be applied on top of the first colorant layer 44. Alternatively, as is shown with reference to the second precoat pixel 42, a third colorant layer 48 having the intended final color may be deposited directly upon the colorant receiving surface of the second precoat pixel 42, without further application of colorant. By applying desired combinations of the three primary colors (cyan, magenta, and yellow) a great range of colors may be represented. Alternatively, color mixing through various known dithering techniques may be used to create an aggregate colorized image on the colorant receiving surfaces of the respective precoat pixels 42.

Figure 4:
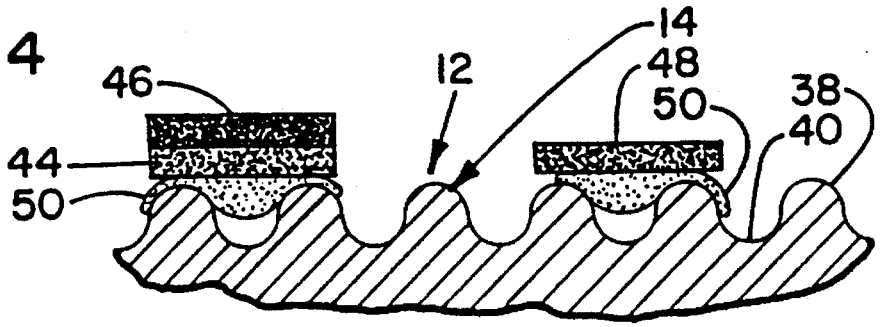
FIG. 4 is a diagrammatical view depicting adhesion of a second type of precoat according to the invention to an underlying substrate.

Referring now to FIG. 4, partial fill-type precoat pixels 50 which are constructed according to a second embodiment of the invention are shown applied to the rough surface 14 of a substrate 12. It will be seen that each precoat pixel 50 is applied to the rough surface 14 so as to partially fill the valleys 40 while leaving some voids in the valleys 40, creating a partial bridging effect between the peaks. The embodiment of FIG. 4, which is considered to be the most preferred embodiment, appears to adhere more effectively to the applied colorant layers 44, 48, than the bridging type precoat depicted in FIG. 3. On the basis of its composition, it may adhere with slightly less force to the rough surface 14 of the substrate 12 than the precoat pixels 42 of the embodiment of FIG. 3 does. This is apparently because the precoat in the embodiment of FIG. 3 contains more EVA, which imparts tackiness, than the precoat depicted in FIG. 4.

Preferably, the precoat pixels 50 in the embodiment of FIG. 4 include from between 20–60% carnauba wax, from between 20–60% paraffin wax, from between 0–20% micro crystalline wax, and from between 5–20% ethylene vinyl acetate (EVA). The most preferred composition is considered to be approximately 40% carnauba wax, 40% paraffin wax, 10% micro crystalline wax, and 10% ethylene vinyl acetate (EVA).

Figure 5:
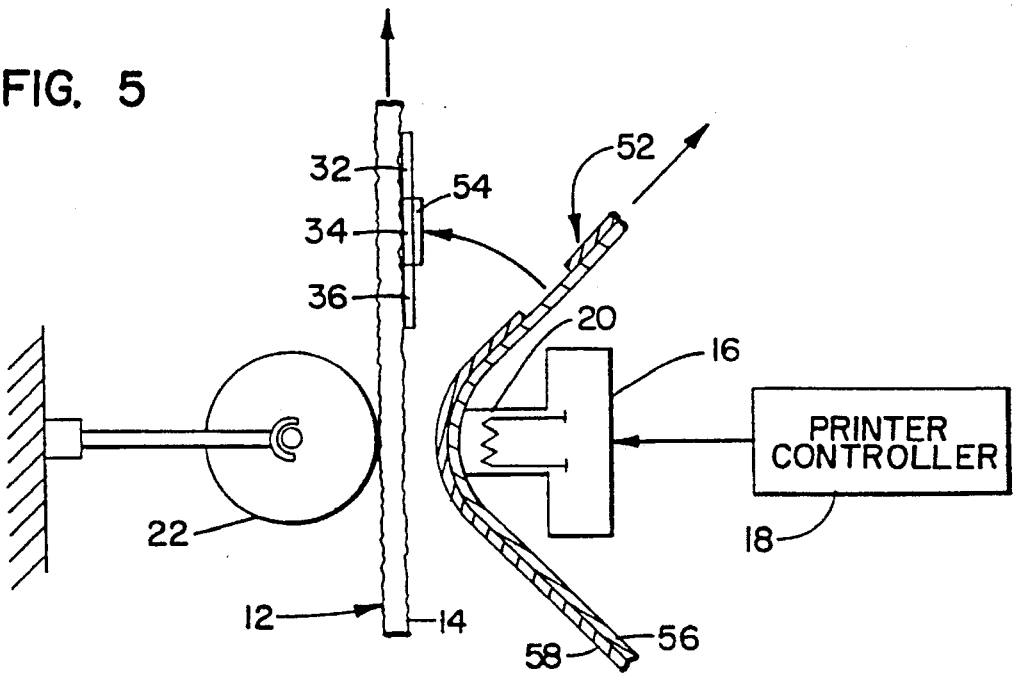
FIG. 5 is a diagrammatical view depicting a wax-transfer type application of colorant to a precoated substrate according to the invention.

FIG. 5 diagrammatically depicts the deposition of a colorant pixel 52 onto an underlying precoat pixel 32 of the type which is applied in the precoating process depicted in FIG. 2. Precoat pixel 32 may be either the embodiment of FIG. 3, or that of FIG. 4. Colorant pixel 54 is preferably applied using the same printhead 16 and printer controller 18 as was used to apply the precoat material. In fact, the preferred embodiment of the invention utilizes a continuous web of ribbon including four repeating lengths of one precoat application ribbon 24 and three colorant application ribbons 52 having the three primary colors, or five repeating lengths of one precoat application ribbon 24 and four colorant application ribbons including the three primary colors plus black. By moving the continuous web of ribbon relative to the printhead 16, both the precoat and subsequent colorant layers may be deposited on to the substrate 12 with a minimum of mechanical manipulation.

Alternatively, a printer including two print heads, one for depositing the precoat pixels and the other for depositing the inks or dyes, may be employed in the practice of the present invention. Such a dual head printer might best be used when the deposition temperature of the colorant differs from that of the precoat and/or when a faster printing speed is desired.

Referring again to the illustrated embodiment, a colorant application ribbon 52 is positioned between the linear array of heating elements 20 on printhead 16 and the target precoat pixel 34 on the substrate 12. As may be seen in FIG. 5, the colorant application ribbon 52 includes a backing layer 56 and a colorant forming layer 58.

As described above with reference to backing layer 26, materials exhibiting heat resistance as well as heat conductivity are preferably employed as the backing layer 56. Exemplary materials include polymer films and papers such as cellophane, polyamide film, polyester film, polyethylene film, polystyrene film, polypropylene film, condenser paper, glassine paper, synthetic paper, laminated paper and the like. Preferable carriers exhibit a thickness of from about 3 microns to about 25 microns and a density of from about 0.8 $g/cm^3$ to about 1.5 $g/cm^3$.

Various thermal wax transfer ribbons are known and commercially available. For example, product numbers CH721U and CH730U (Seiko Instruments), 50-080 and 50-081 (NEC Technologies), 805T13-10C3H and 805T13-10C4H (QMS), 0160906-01 and 016-0906-00 (Tektronix) or the like are known. Wax transfer inks useful in embodiments of the present invention include at least one colorant dispersed in a wax base. A variety of colorants, including those commonly employed in thermal wax transfer printing, are useful in accordance with the present invention. Exemplary colorants are recited below.

Yellow colorants include pigments, such as C. I. Pigment Yellow 10, 12, 16, 31, 34, 36 and 37; and dyes, such as C. I. Solvent Yellow 34 and those dyes recited below; and the like.

Magenta colorants include pigments such as C. I. Pigment Red 5, 49, 57:1, 60, 81 and 83; dyes such as C. I. Solvent Red 49 and those dyes recited below; and the like.

Cyan colorants include pigments such as C. I. Pigment Blue 2, 15, and 17; dyes such as C. I. Solvent Blue 4 and those dyes recited below; and the like.

Black colorants useful in the practice of the present invention include C. I. Pigment Black 6, 7, and 18, C. I. Solvent Black 7 and the like. For the purposes of this description, black is considered to be a color.

Similarly, a variety of wax binders and other wax base components, including those commonly employed in thermal wax transfer printing, may be used in accordance with the present invention. Exemplary wax-based components are vegetable waxes such as carnauba wax, Japan wax, ouricury wax, esparts wax and the like; animal waxes such as bees wax, insect wax, shellac wax, spermaceti wax and the like; petroleum waxes such as paraffin wax, microcrystalline wax, ester wax, oxidized wax and the like; mineral waxes such as montan wax, azocerite, ceresine and the like; higher fatty acids such as palmitic acid, stearic acid, margaric acid, behenic acid and the like; higher alcohols such as palmityl alcohol, stearyl alcohol, behenyl alcohol, margaryl alcohol, myricyl alcohol, eicosanol and the like; higher fatty acid esters such as cetyl palmitate, myricyl palmitate, cetyl stearate, myricyl stearate and the like; amides such as acetamide, propionic acid amide, palmitic acid amide, stearic acid amide, oleic acid amide, amide wax and the like; polyamides; primary and secondary fatty acid amides; rosin derivatives such as ester gum, rosin maleic acid resin, rosin phenol resin, hydrogenated rosin and the like; rosin esters; macromolecular compounds having a softening point of from about 40° C. to about 120° C., such as phenol resin, terpene resin, cyclopentadiene resin, aromatic resin and the like; higher amines such as stearylamine, behenylamine, palmitinamine and the like; polyethylene oxides such as polyethylene glycol 4000, polyethylene glycol 6000 and the like; and the like. These materials may be used independently or in combination to form a base for a thermal wax transfer ink useful in the practice of the present invention.

Wax bases for thermal wax transfer inks optionally include components facilitating heat-induced ink transferability, such as softening agents, extender pigments and the like. Softening agents are employed, if necessary, to insure that the thermal wax transfer inks soften appropriately at the temperature at which thermal transfer print head heating elements operate. Preferred softening agents include materials that exhibit heat-induced melting at print head heating element temperature, such as petroleum resins, polyvinyl acetate, polystyrene, styrene-butadiene copolymer, cellulose esters, cellulose ethers, acrylic resins, lubricating oils such as mineral oils and the like. EVA may also be used. Softening agents are preferably employed at concentrations of from about 3% to about 25%, based upon total dry weight of the thermal wax transfer ink.

Examples of preferred (i.e., transparent) extender pigments providing improved transfer of melted inks are magnesium carbonate, calcium carbonate, kaolin clay, sericite, and precipitated silica. The extender pigment is preferably employed at a concentration less than about 10%, more preferably from about 2% to about 10%, based on total dry weight of the thermal wax transfer ink.

Preferable thermal wax transfer inks contain from about 1% to about 20% of a colorant; from about 20% to about 80% of a wax binder; and from about 3% to about 25% of a softening agent, based on total dry weight of the thermal wax transfer ink. Thermal wax transfer inks are coated onto a carrier, preferred structures of which are described below. Hot-melt coating, solvent coating or like processes may be used for this purpose. The thickness of the coated thermal wax transfer ink layer is generally less than about 20 microns, with from about 1 micron to about 10 microns preferred.

Preferably, the wax-based colorant forming layer 58 in application ribbon 52 is formulated so as to have a lower melting point than the melting point of precoat pixels 32,34,36. This prevents melt-related structural degradation from affecting the precoat pixels 32,34,36 during deposition of the colorant thereon. A comparison of the most preferred compositions for the precoat material with that for the colorant material will show that the precoat material has a higher proportion of carnauba wax, which has a higher melting point than paraffin wax or microcrystalline wax. This raises the melting point of the precoat compositions above that of the colorant composition.

In addition, precoat forming layer 28 is preferably thicker than colorant forming layer 58. This increases the strength of the deposited precoat pixels 32,34,36 relative to the mass of the colorant upon deposition, thereby preventing structural damage to the precoating which might affect overall image quality.

The precoat material preferably also has a higher viscosity than the colorant material. It is estimated that the most preferred precoat composition will have a viscosity at 100degrees Celsius of about 250 to 300 centipoise. At the same temperature, the most preferred colorant will have a viscosity of about 100 centipoise. The higher viscosity of the precoat make the precoat pixels 32,34,36 more stability to accept a deposit of colorant without deformation. The lower viscosity of the colorant facilitates binding to the precoat.

Colorant forming layer 58 preferably includes from between 1–20% ink or pigmentation, 3–10% softening agents, and from between 70% to 90% wax binder. Most preferably, colorant forming layer 58 includes about 60% paraffin wax, 20% carnauba wax, 5% EVA as a softening agent and to impart a measure of tackiness, 10% microcrystalline wax and 5% colorant. Colorant layer 58 is preferably about 3 microns in thickness.

In operation, printer controller 18 instructs a heating element 20 to heat an area of colorant application ribbon 52 which corresponds to the distal surface area of the heating element 20 to a predetermined temperature, at which temperature the colorant forming layer 58 softens and adheres itself to the target precoat pixel 34. Preferably, forming layer 58 does not actually melt.

A printed product for conveying information to a viewer formed by the above process includes substrate 12, an image-enhancing precoat applied to substrate 12 in discrete pixels 32,34,36 and at least one colorant pixel 54 applied to a corresponding number of precoat pixels 34. The precoat pixels 32,34,36 are arranged on the substrate 12 such that at least one precoat pixel 32,36 is positioned immediately adjacent to each precoat pixel that has a colorant pixel 54 applied thereto, but so that no precoat is applied to any pixel which is not immediately adjacent to a precoat pixel to which colorant has been applied. According to the most preferred embodiment of this aspect of the invention, each precoat pixel 34 that has a colorant pixel 54 applied thereto is surrounded by adjacent precoat pixels 32,36, thereby forming a border of precoat about each colorant pixel.

Figure 6:
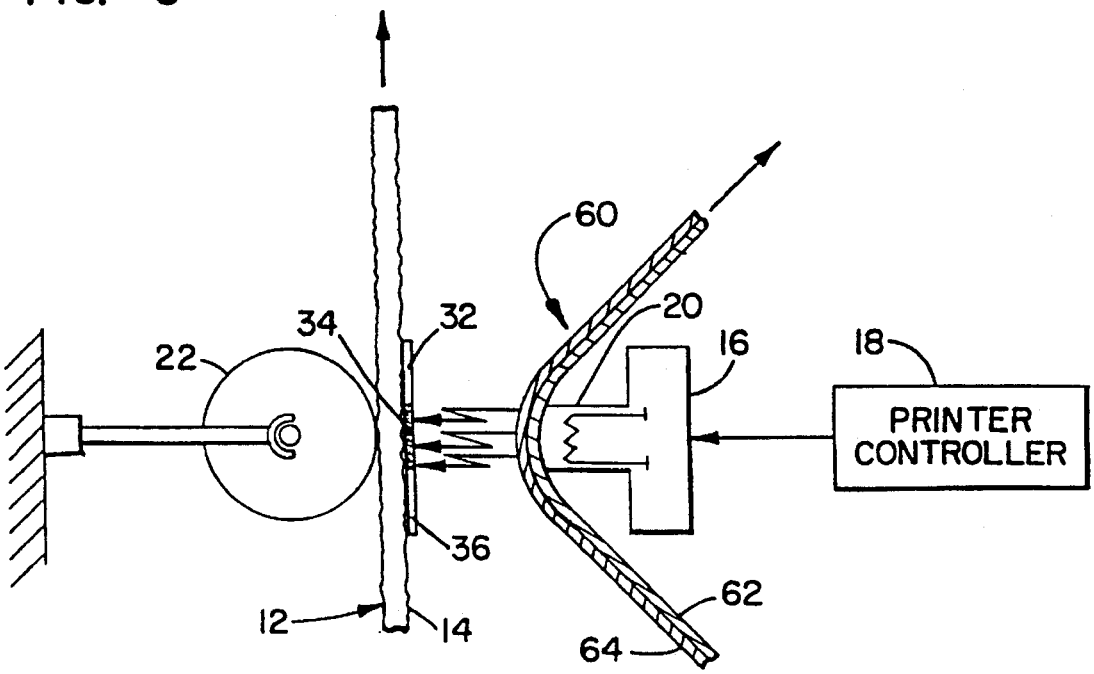
FIG. 6 is a diagrammatical view depicting application of a colorant to a precoated substrate through a dye diffusion process.

An alternative system and method for applying a colorant to the target precoat pixel 34 is depicted in FIG. 6. As may be seen in FIG. 6, a dye-diffusion type colorant application ribbon 60 is positioned between the linear array of heating elements 20 on printhead 16 and the target precoat pixel 34. Colorant application ribbon 60 includes a backing layer 62, and a dye diffusion carrier layer 64, which, when heated, causes a dye material impregnated into the carrier layer 64 to diffuse into the adjacent target precoat pixel 34. By varying the temperature and time of exposure of the colorant application ribbon 60 to the heating element 20, the amount of dye which is caused to be diffused into the target precoat pixel 34 may be more precisely controlled than is possible with the wax transfer technique used in the embodiment of FIG. 5. In the most preferred embodiment of operation, dye diffusion printing proceeds as follows: a piece of rough paper 12 is placed in a dye diffusion printer having a continuous carrier ribbon, upon which imaging enhancing material, yellow dye, magenta dye and cyan dye are disposed in sequential repeating units in the longitudinal direction; full coating or selective coating of the substrate by local application of heat to the image enhancing precoat ribbon by heating elements of the print head 16; and image generation on the substrate surface 14 by local application of heat to the successive yellow, magenta and cyan dye/carrier ribbon portions by heating elements of the print head.

Preferably, the precoating material used in dye diffusion embodiment of the present invention is capable of deposition upon a rough substrate surface by conventional or slightly modified dye diffusion printers. Since dye diffusion and thermal wax transfer printers operate in the same manner (i.e., using local application of heat to induce deposition), a wax-based or other substantially similar image enhancing precoat is potentially depositable thereby.

Control of print head heating element temperature is required, if the dyes and precoat exhibit substantially different migration and melting temperatures. More specifically, a different temperature may be required to melt-deposit the image enhancing precoat than that necessary to migrate-deposit the dyes. Dual head temperature, dual head or other suitable apparatus may be employed in such embodiments of the present invention.

For dye diffusion embodiments of the present invention, the image enhancing precoat must be compatible with the dyes employed therewith. In this situation, the term "compatible" connotes the ability to physically or chemically interact with the dye to permit the generation of a bright colored image. Images having this desirable color brightness characteristic are generated as a result of molecular II dispersion of the dyes. Absent the ability to molecularly disperse, the dye molecules preferably adhere to each other. A paper substrate used in the practice of the present invention is not itself amenable to molecular dye dispersion therewithin. As a result, dyes are preferably miscible or form a solid-in-solid solution with the image enhancing precoat of the dye diffusion embodiments of the present invention. Dye dispersion in the image enhancing precoat is analogous, for example, to the process as it occurs between a dye and a polymer film.

Image enhancing precoats useful in this embodiment of the present invention are therefore selected, in part, on the basis of dye solubility or miscibility. Dye solid-in-solid solution forming materials, such as organic polymers, polyamide waxes or the like, are exemplary of image enhancing precoats for employment in the practice of the present invention.

In addition, image enhancing precoats may include one or more additives capable of facilitating dye diffusion. For example, particulate material(s), such as finely divided polymer powder or the like, may be dispersed in an image enhancing precoat, such as a low melting adhesive compound (e.g., a polyamide, a wax or the like. For example, polyester particles exhibiting diameters of about 10 microns or less may be employed in the practice of the present invention. Upon application of an appropriate amount of heat, the dye migrates from the carrier and becomes molecularly dispersed within the precoat containing such particulate matter, thereby generating bright colored images on the substrate, which itself is not amenable to such dye dispersion.

The thickness of the particulate-containing precoat layer to be deposited upon a substrate in the practice of the present invention depends upon factors such as the level of particulate loading. Generally, as the concentration of particulate matter in the precoat material increases, the thickness of the layer necessary to generate a solid-in-solid solution decreases. The amount of dye to be dispersed at any location influences the lower physical limit of precoat thickness (i.e., the layer must be thick enough to accommodate the particulate loading and dye dispersion). Also, the desirability of a predictable optical density of color dictates, at least in part, the precoat thickness parameter. Optical density predictability is a function of precoat layer evenness, among other things, and a thicker layer is therefore preferable for this purpose. Since the chemistry and physical structure of the dyes and precoat components are known or ascertainable, a practitioner in the art is capable of preparing and implementing image enhancing moieties or precoats useful in dye diffusion embodiments of the present invention.

Figure 7:
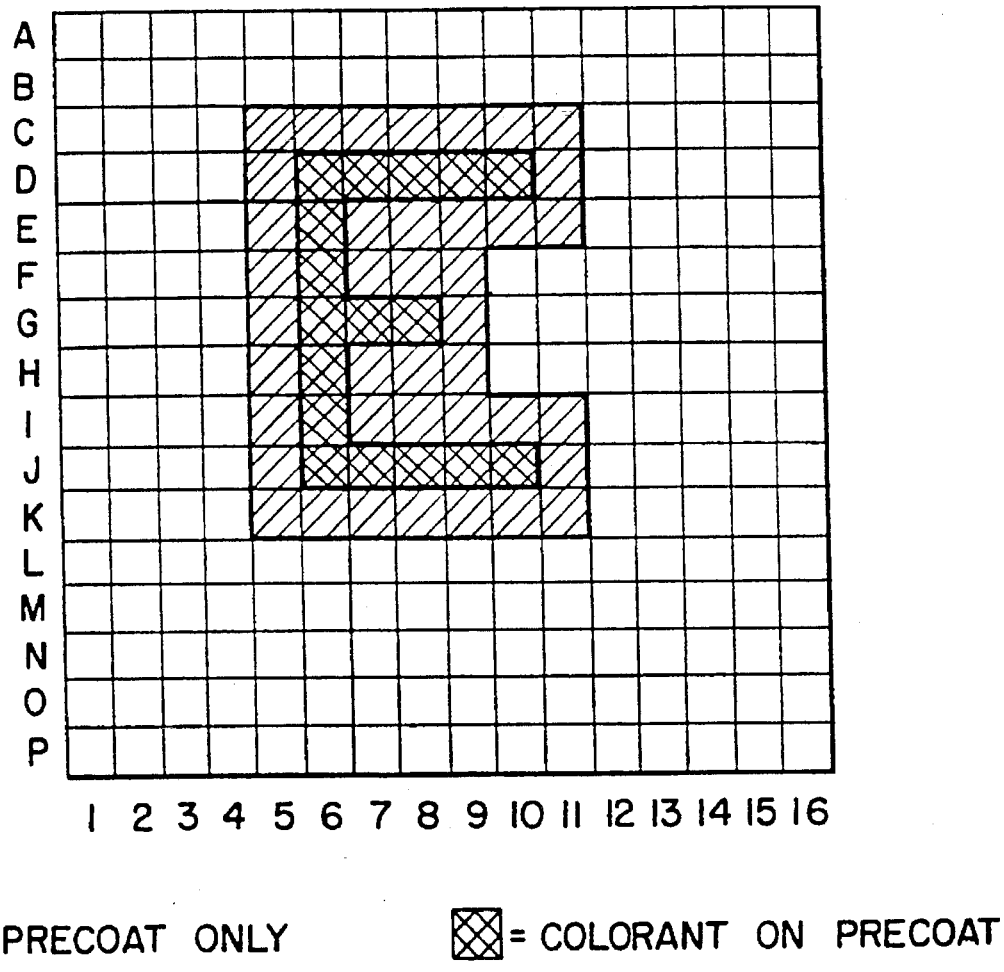
FIG. 7 is a diagrammatical depiction of a novel method for applying precoat to a substrate according to one aspect of the invention.

Another important aspect of the invention is depicted in FIG. 7. As may be seen in FIG. 7, the precoat material according to the present invention is applied to a broader area of the substrate 12 than the area upon which deposit of colorant is intended, but is not applied to the entire surface of the substrate 12, which would cause a noticeable change in the surface texture of the substrate 12. More particularly, the preferred embodiment of the invention provides a system and method for applying the image enhancing precoat to each predetermined pixel on the substrate where colorant is to be located, and also to at least one pixel which is immediately adjacent to each such predetermined pixel, but not to any pixels which are not one of the predetermined pixels or are not immediately adjacent to one of the predetermined pixels. As a result, adherence of the precoat to the substrate is further assured, without unnecessarily wasting precoat or changing the apparent surface texture of the substrate.

According to the most preferred embodiment of the invention, the image enhancing precoat is applied to every pixel which is immediately adjacent to each pixel upon which deposit of colorant is intended, so that a border of precoat is formed about each of the pixel upon which the deposit of colorant is intended.

Figure 10:
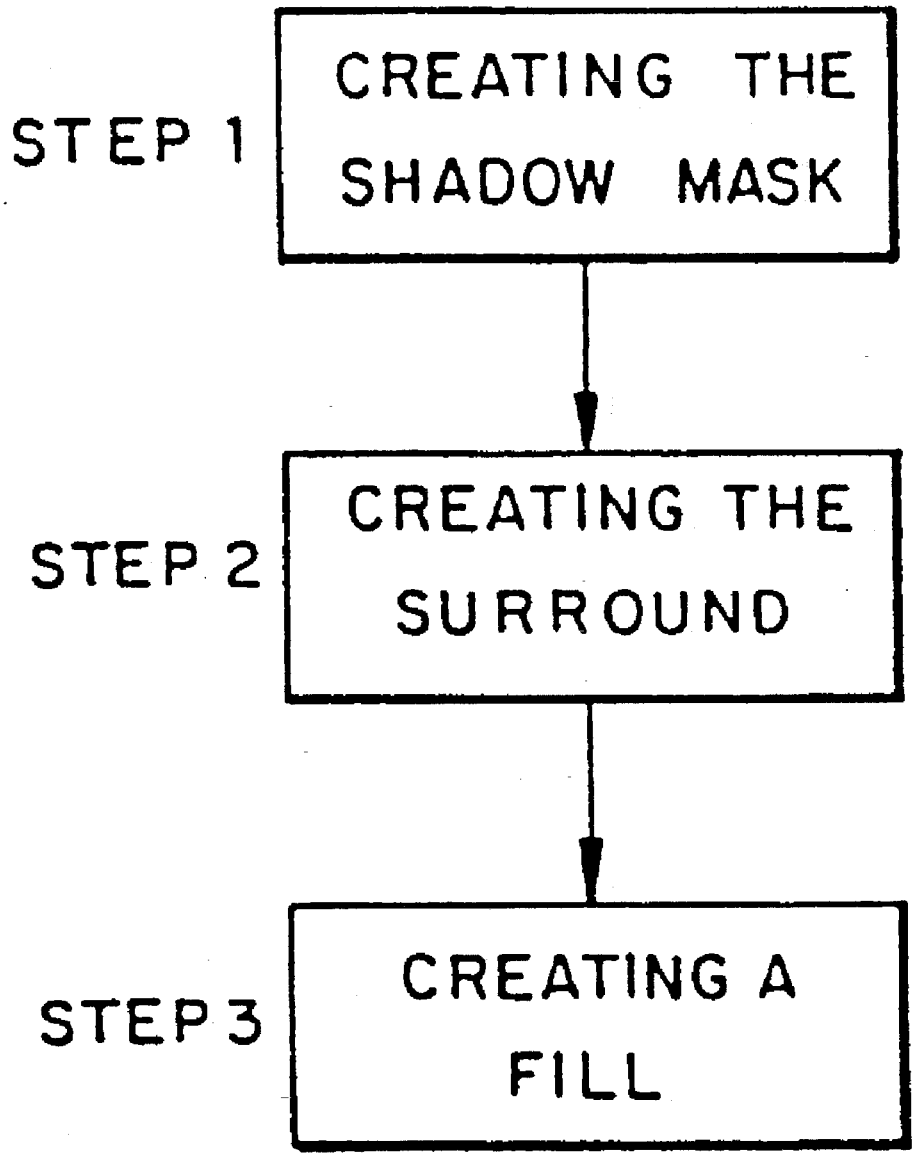
FIG. 10 is a flow chart depicting one aspect of the invention.

To perform this process, printer controller 18 first determines, on a pixel by pixel basis, where colorant and underlying image enhancing precoat are to be located on the substrate. This step, depicted schematically in FIG. 10, may be termed creating a "shadow mask." Printer controller 18 then determines, also on a pixel by pixel basis, where additional exposed precoat is to be located contiguous with the underlying image enhancing precoat. This second step, also depicted in FIG. 10, is termed creating a "surround." Printer controller 18 then carries out application of the image enhancing precoat to each predetermined pixel on the substrate where colorant is to be located, and also to at least one additional pixel which is contiguous to each area were pixels of colorant are to be located. Printer controller 18 then instructs for the deposit of colorant onto the underlying precoat, but not on to the additional exposed precoat.

As a third, optional step, printer controller 18 may be programmed to adjust the surround pattern based on the configuration of the shadow mask. This step, also shown in FIG. 10, is termed "creating a fill." In areas where the colorant is intended to be sparsely distributed, for example, fill creation may entail applying precoat to more than only the pixels which are immediately adjacent to pixels where colorant is intended for deposit. In areas of greater density, the precoat border area may be reduced.

As an example of the preferred embodiment, printer controller 18 may first determine that deposit of colorant is intended for pixel (G,8) as represented in FIG. 7, as part of the formation of the letter "E." Once such a determination is made by the printer controller 18, printer controller 18 makes a further determination that precoat will be applied to each pixel which is adjacent to pixel (G,8), which are, namely, pixels (F,7), (F,8), (F,9), (G,9), (H,9), (H,8), (H,7), and (G,7). Once printer controller 18 makes this determination, it instructs system 10 to apply precoat to the predetermined pixels. In the illustrated embodiment, the creation of a fill does not change the configuration of the precoat border. Subsequently, colorant is deposited upon the preselected pixel (G,8). This process may be performed by the printer controller 18 on a line by line, or on an area by area basis. Alternatively, a larger border of precoat including more than the immediately adjacent pixels could equally be provided for under the invention.

A printed product as depicted in FIG. 7 will include a substrate 12, an image-enhancing precoat applied to the substrate in discrete pixels 32,34,36 and at least one colorant pixel 54 applied to a corresponding number of precoat pixels 34, wherein the precoat pixels are arranged on the substrate such that at least one precoat pixel is positioned immediately adjacent to each precoat pixel that has a colorant pixel applied thereto, but so that no precoat is applied to any pixel which is not immediately adjacent to a precoat pixel to which colorant has been applied. Most preferably, each precoat pixel 34 that has a colorant pixel 54 applied thereto is surrounded by adjacent precoat pixels 32,36, thereby forming a border of precoat about each colorant pixel. The colorant could be applied according to the embodiment of the invention shown in FIG. 5, or that shown in FIG. 6.

Figure 8:
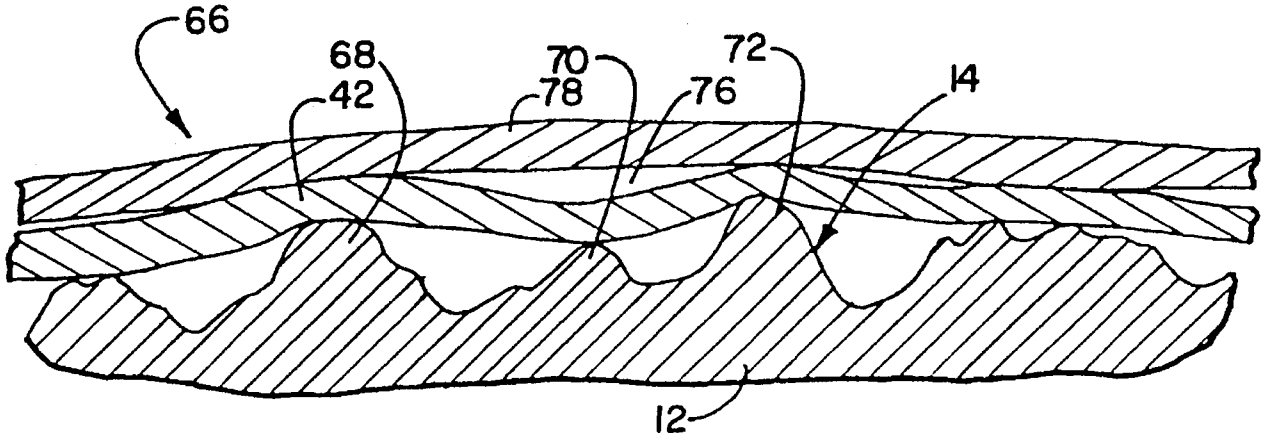
FIG. 8 is a diagrammatical depiction of a novel colorant material according to another aspect of the invention overlying a precoat material which has been applied in accordance with the embodiment of FIG. 3.
Figure 9:
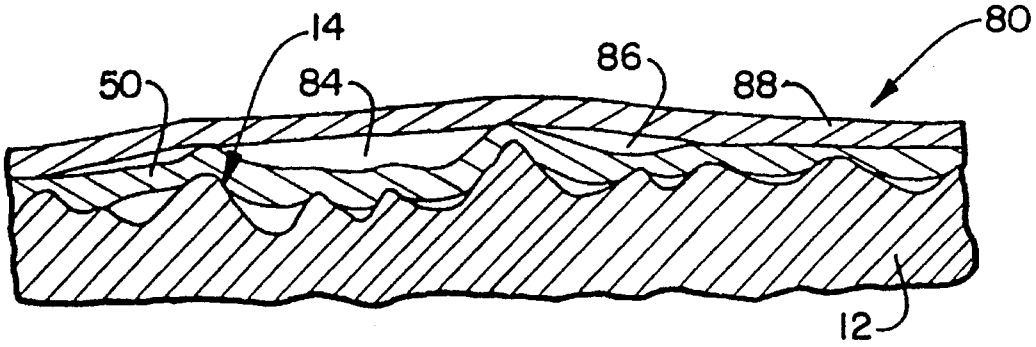
FIG. 9 depicts the colorant material of FIG. 8 overlying a precoat material which has been applied in accordance with the embodiment of FIG. 4.

Referring now to FIGS. 8 and 9, it will be seen that a printed product 66,80 according to one aspect of the invention includes the substrate 12, an image enhancing precoat 42, 50 adhered to the substrate 12, the precoat having a colorant receiving surface which has at least one void defined therein, and a colorant adhered to the colorant receiving surface, the colorant 78, 88 being formulated and deposited so as to bridge over the voids in the colorant receiving surface.

Referring briefly to FIG. 8, it will be seen that rough surface 14 and substrate 12 includes adjacent peaks 68, 70, and 72. Peaks 68 and 72 are substantially higher than peak 70, which is positioned between the peaks 68, 72. As a result of this height differential, the precoat pixel 42, which is constructed and formulated according to the embodiment of FIG. 3, while bridging the adjacent peaks 68, 70, 72, drops slightly downwardly to adhere itself to the second peak 70 between the peaks 68, 72. This creates a void 76 between the precoat pixel 42 and the colorant pixel 78. Colorant pixel 72 is formulated so as to bridge the void 76 without detrimental effects, such as cracking or breaking.

Similarly, FIG. 9 depicts a printed product 80 were the precoat material is a precoat pixel 50 which is formulated and deposited according to the embodiment of FIG. 4. To the extent that the precoat pixel 50 drops down into the valleys of the substrate 12 to accommodate itself to the rough surface 14, voids 84, 86 may be formed between the precoat pixel 50 and the colorant pixel 88. Colorant pixel is, again, formulated to bridge over those voids 84, 86 without detriment such as cracking or breaking.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of thermal transfer printing on a substrate of the type which is characterized by a rough surface having peaks and valleys, comprising the following steps:

(a) applying an image enhancing precoat to the rough surface by application means employing heat locally to induce deposition of the image enhancing precoat so as to form complete bridges across the valleys of said rough surface between adjacent peaks while leaving voids in said valleys between said adjacent peaks so as to create a colorant receiving surface more uniform than said rough surface; and (b) subsequently depositing a colorant on the colorant receiving surface of the applied image enhancing precoat.

2. A method according to claim 1, wherein step (a) is performed by applying the precoat selectively to desired areas of the rough surface based on where the deposit of colorant is intended.

3. A method according to claim 2, wherein the precoat is applied to a larger area than an area on which colorant is deposited in step (b), whereby the colorant is assured of being deposited on the precoat even in the event of a slight misalignment.

4. A method according to claim 1, wherein step (b) is performed by depositing the colorant using a thermal wax transfer printing process.

5. A method according to claim 1, wherein step (b) is performed using a diffusion dye transfer process.

6. A method according to claim 1, wherein step (a) is performed using a thermal wax transfer process.

7. A method according to claim 1, wherein step (a) and step (b) are both performed on a pixel-by-pixel basis, and step (a) is performed so as to apply precoat to all pixels where colorant is intended to be transferred, as well as to at least one pixel that is immediately adjacent to each of said pixels where colorant is intended to be transferred, whereby the precoat will adhere to the surface more reliably.

8. A method according to claim 7, wherein step (a) is performed so as to apply precoat to all pixels where colorant is intended to be deposited, as well as all adjacent pixels to each pixel where colorant is intended to be deposited, thereby creating a precoat border around each pixel to which colorant deposition is intended.

9. A method of thermal transfer printing on a substrate of the type which is characterized by a rough surface having peaks and valleys, comprising the following steps:

(a) applying an image enhancing precoat to the rough surface by application means employing heat locally to induce deposition of the image enhancing precoat which partially fills the valleys of said rough surface while leaving some voids in the valleys, creating a partial bridging effect between said peaks, thereby forming a colorant receiving surface which is more uniform than said rough surface; and (b) subsequently depositing a colorant on the colorant receiving surface of the applied image enhancing precoat.

10. A method according to claim 9, wherein step (a) is performed by applying the precoat selectively to desired areas of the rough surface based on where the deposit of colorant is intended.

11. A method according to claim 10, wherein the precoat is applied to a larger area than an area on which colorant is deposited in step (b), whereby the colorant is assured of being deposited on the precoat even in the event of a slight misalignment.

12. A method according to claim 9, wherein step (b) is performed by depositing the colorant using a thermal wax transfer printing process.

13. A method according to claim 9, wherein step (b) is performed using a diffusion dye transfer process.

14. A method according to claim 9, wherein step (a) is performed using a thermal wax transfer process.

15. A method according to claim 9, wherein step (a) and step (b) are both performed on a pixel-by-pixel basis, and step (a) is performed so as to apply precoat to all pixels where colorant is intended to be transferred, as well as to at least one pixel that is immediately adjacent to each of said pixel where colorant is intended to be transferred, whereby the precoat will adhere to the surface more reliably.

16. A method according to claim 15, wherein step (a) is performed so as to apply precoat to all pixels where colorant is intended to be deposited, as well as all adjacent pixels to each pixel where colorant is intended to be deposited, thereby creating a precoat border around each pixel to which colorant deposition is intended.

17. A system for thermal transfer printing on a substrate of the type which is characterized by a rough surface having peaks and valleys, comprising:

means for applying an image-enhancing precoat on to the rough surface by application means employing heat locally to induce deposition of the image enhancing precoat so as to form complete bridges across the valleys of said rough surface between adjacent peaks while leaving voids in said valleys between said peaks so as to create a colorant receiving surface more uniform than said rough surface; and means for subsequently depositing a colorant having a first color on the colorant receiving surface of the applied image enhancing precoat.

18. A system according to claim 17, wherein said means for applying is constructed and arranged to apply the precoat selectively to desired areas of the rough surface based on where the deposit of colorant is intended.

19. A system according to claim 18, wherein said means for applying is further constructed and arranged to apply the precoat to a larger area than an area on which colorant is deposited, whereby the colorant is assured of being deposited on the precoat even in the event of a slight misalignment.

20. A system according to claim 17, wherein said means for depositing comprises a thermal wax transfer printer.

21. A system according to claim 17, wherein said means for depositing comprises a diffusion dye transfer printer.

22. A system according to claim 17, wherein said means for applying comprises a thermal wax transfer printer.

23. A system according to claim 17, further comprising a printer controller for controlling said means for applying and said means for depositing.

24. A system according to claim 23, wherein said means for applying and said means for depositing are both constructed and arranged to operate on a pixel-by-pixel basis, and said printer controller is constructed and arranged to instruct said means for applying to apply precoat to all pixels where colorant is intended to be deposited, as well as to at least one pixel that is immediately adjacent to each pixel where colorant is intended to be deposited, whereby the precoat will adhere to the surface more reliably.

25. A system according to claim 24, wherein said printer controller is constructed and arranged to instruct said means for applying to apply precoat to all pixels where colorant is intended to be deposited, as well as all adjacent pixels to each pixel where colorant is intended to be deposited, thereby creating a precoat border around each pixel to which colorant deposition is intended.

26. A system for thermal transfer printing on a substrate of the type which is characterized by a rough surface having peaks and valleys, comprising:

means for applying an image-enhancing precoat on to the rough surface by application means employing heat locally to induce deposition of the image enhancing precoat which partially fills the valleys of said rough surface while leaving some voids in the valleys, creating a partial bridging effect between said peaks, thereby forming a colorant receiving surface which is more uniform than said rough surface; and means for subsequently depositing a colorant having a first color on the colorant receiving surface of the applied image enhancing precoat.

27. A system according to claim 26, wherein said means for applying is constructed and arranged to apply the precoat selectively to desired areas of the rough surface based on where the deposit of colorant is intended.

28. A system according to claim 27, wherein said means for applying is further constructed and arranged to apply the precoat to a larger area than an area on which colorant is deposited in step (b), whereby the colorant is assured of being deposited on the precoat even in the event of a slight misalignment.

29. A system according to claim 26, wherein said means for depositing comprises a thermal wax transfer printer.

30. A system according to claim 26, wherein said means for depositing comprises a diffusion dye transfer printer.

31. A system according to claim 26, wherein said means for applying comprises a thermal wax transfer printer.

32. A system according to claim 26, further comprising a printer controller for controlling said means for applying and said means for depositing.

33. A system according to claim 32, wherein said means for applying and said means for depositing are both constructed and arranged to operate on a pixel-by-pixel basis, and said printer controller is constructed and arranged to instruct said means for applying to apply precoat to all pixels where colorant is intended to be deposited, as well as to at least one pixel that is immediately adjacent to each pixel where colorant is intended to be deposited, whereby the precoat will adhere to the surface more reliably.

34. A system according to claim 33, wherein said printer controller is constructed and arranged to instruct said means for applying to apply precoat to all pixels where colorant is intended to be deposited, as well as all adjacent pixels to each pixel where colorant is intended to be deposited, thereby creating a precoat border around each pixel to which colorant deposition is intended.

35. A method of thermal transfer printing on a substrate, comprising the steps of:

(a) determining, on a pixel by pixel basis, where colorant is to be located on the substrate;

(b) applying an image-enhancing precoat to each predetermined pixel on the substrate where colorant is to be located, and also, on a pixel-by-pixel basis, to at least one pixel which is immediately adjacent to each predetermined pixel, whereby adherence of the precoat to the substrate is further assured; and (c) depositing a colorant onto the precoated predetermined pixels.

36. A method according to claim 35, wherein step (b) comprises applying the image-enhancing precoat to every pixel which is immediately adjacent each predetermined pixel, thereby forming a border of precoat about each of the predetermined pixels.

37. A method according to claim 35, further comprising the step of determining, prior to step (b), on a pixel-by-pixel basis, where precoat is to be applied to the substrate.

38. A method according to claim 35, wherein step (b) is performed using a thermal wax transfer printer.

39. A method according to claim 35, wherein step (c) is performed using a thermal wax transfer printer.

40. A method according to claim 35, wherein step (c) is performed using a diffusion dye type printer.

41. A system for thermal transfer printing on a substrate, comprising:

means for determining, on a pixel by pixel basis, where colorant is to be located on the substrate;

means for applying an image-enhancing precoat to each predetermined pixel on the substrate where colorant is to be located, and also, on a pixel-by-pixel basis, to at least one pixel which is immediately adjacent to each predetermined pixel, whereby adherence of the precoat to the substrate is further assured; and means for depositing colorant on to the precoated predetermined pixels.

42. A system according to claim 41, wherein said means for applying is constructed and arranged to apply precoat to every pixel which is immediately adjacent each predetermined pixel, thereby creating a border of precoat about the predetermined pixels.

43. A system according to claim 41, further comprising means for determining, on a pixel-by-pixel basis, where precoat is to be applied to the substrate.

44. A system according to claim 41, wherein said means for applying comprises a thermal wax transfer printer.

45. A system according to claim 41, wherein said means for depositing comprises a thermal wax transfer printer.

46. A system according to claim 41, wherein said means for depositing comprises a diffusion dye type printer.

47. A printed product for conveying information to a viewer, comprising:

a substrate;

an image-enhancing precoat applied to said substrate in discrete pixels by application means employing heat locally to induce deposition of the image-enhancing precoat; and at least one colorant pixel applied to a corresponding number of precoat pixels, wherein said precoat pixels are arranged on said substrate such that at least one precoat pixel is positioned immediately adjacent to each precoat pixel upon which colorant is deposited, whereby each precoat pixel upon which colorant has been deposited is surrounded by at least a partial border of exposed precoat.

48. A product according to claim 47, wherein each precoat pixel that has a colorant pixel applied thereto is surrounded by adjacent precoat pixels, thereby forming a border of precoat about each colorant pixel.

49. A product according to claim 47, wherein said precoat is substantially the same color as said substrate.

50. A product according to claim 47, wherein said precoat is substantially transparent.

51. A product according to claim 47, wherein said precoat at least partially bridges valleys defined in a surface of said substrate to which said precoat has been applied.

52. A product according to claim 47, wherein said precoat partially, but not entirely, fills valleys defined in a surface of said substrate to which said precoat has been applied.

53. A product according to claim 47, wherein said precoat is wax-based.

54. A product according to claim 53, wherein said precoat comprises a mixture of carnauba wax, paraffin wax, microcrystalline wax and ethylene vinyl acetate.

55. A product according to claim 54, wherein said precoat is approximately forty percent carnauba wax, forty percent paraffin wax, ten percent microcrystalline wax, and ten percent ethylene vinyl acetate.

56. A product according to claim 47, wherein said colorant pixel is absorbed into said precoat through sublimation dye transfer.

57. A product according to claim 47, wherein said precoat has a higher melting point than said colorant.

58. A product according to claim 47, wherein said precoat has a higher viscosity than said colorant.

59. A product according to claim 47, wherein said precoat is thicker than said colorant pixel.

60. A method of thermal transfer printing on a substrate, comprising:

(a) determining, on a pixel-by-pixel basis, where colorant and underlying image-enhancing precoat are to be located on the substrate;

(b) determining, on a pixel by pixel basis, where additional exposed precoat is to be located contiguous with the underlying image-enhancing precoat;

(c) applying the image-enhancing precoat to each predetermined pixel on the substrate where colorant is to be located and also to at least one additional pixel which is contiguous to each area where pixels of colorant are to be located whereby adherence of the precoat to the substrate is further assured; and (d) depositing colorant onto the underlying precoat but not the additional exposed precoat.

61. A method according to claim 60, wherein step (c) comprises applying the image-enhancing precoat to every pixel which is immediately adjacent each predetermined pixel, thereby forming a border of precoat about each of the predetermined pixels.

62. A method according to claim 60, wherein step (c) is performed using a thermal wax transfer printer.

63. A method according to claim 60, wherein step (d) is performed using a thermal wax transfer printer.

64. A method according to claim 60, wherein step (d) is performed using a diffusion dye type printer.

65. A method of producing high quality color images, having a decrease in number or severity of image voids, on a substrate characterized by a rough surface using a dye diffusion printing technique to selectively deposit a desired amount of one or more dyes onto the substrate surface, the method which comprises depositing an image enhancing precoat on the substrate surface using a dye diffusion print engine prior to dye deposition, wherein the image enhancing precoat exhibits compatibility with the substrate surface sufficient to provide, in combination with the substrate surface, a more uniform printing surface and achieves molecular dispersion of the one or more dyes by interacting with the one or more dyes to exhibit compatibility in the form of bright color image generation with the dye sufficient to permit dye diffusion.

66. An image production method according to claim 65 wherein the image enhancing precoat is wax-based and is deposited on the substrate surface by a different mechanism than the dye.

67. An image production method according to claim 65 wherein the image enhancing precoat comprises finely divided polymer materials, other dye compatible particulate material or combinations thereof.

68. An image production method according to claim 65 wherein the image enhancing precoat at least partially fills or bridges voids located on the substrate surface.

69. An image production method according to claim 65 wherein the image enhancing precoat is translucent.

70. An image production method according to claim 65 wherein the image enhancing precoat comprises a white colorant.

71. An image production method according to claim 65 wherein the image enhancing precoat is deposited over the substrate surface in a full page manner.

72. An image production method according to claim 65 wherein the image enhancing precoat is selectively deposited on the substrate surface only at a location where one or more dyes are to be subsequently deposited.

73. A transfer mechanism for producing high quality color images, having a decrease in number or severity of image voids, on a substrate characterized by a rough surface using a dye diffusion printing technique to selectively deposit an image enhancing precoat on the substrate surface prior to dye deposition, such mechanism comprising:

an image enhancing portion comprising an image enhancing precoat exhibiting compatibility with the substrate surface sufficient to provide, in combination with the substrate surface, a more uniform printing surface, and a support therefor; and at least one colored portion comprising a dye or a mixture of dyes exhibiting compatibility with the image enhancing precoat sufficient to permit dye diffusion and a support and therefore to achieve molecular dispersion of the one or more dyes by their interaction with the image-enhancing precoat.

74. A transfer mechanism according to claim 73, comprising magenta, cyan and yellow colored portions.

75. A transfer mechanism according to claim 74, further comprising a black colored portion.

76. A transfer mechanism according to claim 73, wherein the image enhancing precoat is wax based.

77. A transfer mechanism according to claim 73, wherein the image enhancing precoat comprises finely divided polymer materials, other dye compatible particulate matter or combinations thereof.

78. A transfer mechanism according to claim 73, wherein the image enhancing precoat is translucent.

79. A transfer mechanism according to claim 73, wherein the image enhancing precoat comprises a white colorant.

80. A printing apparatus for producing high quality color images, having a decrease in number or severity of image voids, on a substrate characterized by a rough surface using a dye diffusion printing technique to selectively deposit an image enhancing precoat on the substrate surface prior to dye deposition, said apparatus comprising:

a print head which exhibits dye diffusion printing capability;

a control means for directing the action of the printhead to achieve deposition of the image enhancing precoat and at least one dye upon the substrate surface; and an input means to communicate desired deposition locations of image enhancing precoat and dye to the control means, wherein the apparatus is used in combination with a transfer mechanism comprising:

an image enhancing portion comprising an image enhancing precoat exhibiting compatibility with the substrate surface sufficient to provide, in combination with the substrate surface, a more uniform printing surface, and a support therefor; and at least one colored portion comprising a dye or a mixture of dyes exhibiting compatibility with the image enhancing precoat sufficient to permit dye diffusion and a support therefor.

81. A printing apparatus according to claim 80, wherein the input means communicates pixel color information corresponding to a desired printed image to the control means.

82. A printing apparatus according to claim 80, wherein the image enhancing precoat is deposited upon a first area of the substrate surface, with the first substrate surface area being larger than a second substrate surface area upon which the dye is to be deposited.

83. A printing apparatus according to claim 82, wherein the second substrate surface area constitutes a neighborhood of the first substrate surface area.

* * * * *